US008065940B2

(12) United States Patent
Wilson et al.

(10) Patent No.: US 8,065,940 B2
(45) Date of Patent: Nov. 29, 2011

(54) TORQUE APPLICATION DEVICE

(75) Inventors: Brandon Wilson, Phoenix, AZ (US); Timothy Lee Youtsey, Scottsdale, AZ (US)

(73) Assignee: PCT International, Inc., Mesa, AZ (US)

( * ) Notice: Subject to any disclaimer, the term of this patent is extended or adjusted under 35 U.S.C. 154(b) by 177 days.

(21) Appl. No.: 12/470,430

(22) Filed: May 21, 2009

(65) Prior Publication Data

US 2010/0294094 A1 Nov. 25, 2010

(51) Int. Cl.
*B25B 23/14* (2006.01)
*B25B 23/155* (2006.01)

(52) U.S. Cl. ..... 81/475; 81/467

(58) Field of Classification Search ..... 81/475, 81/467; 29/758
See application file for complete search history.

(56) References Cited

U.S. PATENT DOCUMENTS

| | | | | |
|---|---|---|---|---|
| 4,215,600 | A * | 8/1980 | Kesselman | 81/471 |
| 4,964,319 | A * | 10/1990 | Chang | 81/58.3 |
| 5,176,050 | A * | 1/1993 | Sauer et al. | 81/471 |
| 5,179,617 | A * | 1/1993 | Stockman | 385/136 |
| 5,299,474 | A * | 4/1994 | Hohmann et al. | 81/471 |
| 5,415,065 | A * | 5/1995 | McMills | 81/467 |
| 6,186,785 | B1 * | 2/2001 | Rogers et al. | 433/141 |
| 6,349,625 | B1 * | 2/2002 | Poganski | 81/475 |
| 6,439,086 | B1 * | 8/2002 | Bahr | 81/467 |
| 6,606,924 | B2 * | 8/2003 | Chandler et al. | 81/90.2 |
| 6,817,272 | B2 * | 11/2004 | Holland | 81/124.2 |
| 6,928,907 | B2 * | 8/2005 | Casabonne et al. | 81/483 |
| 7,011,001 | B2 * | 3/2006 | Knox et al. | 81/467 |
| 7,032,481 | B2 * | 4/2006 | Li et al. | 81/429 |
| 7,080,581 | B2 * | 7/2006 | Reese | 81/475 |
| 7,222,559 | B2 * | 5/2007 | Wang | 81/467 |
| 7,299,725 | B2 * | 11/2007 | Helstern et al. | 81/471 |
| 7,347,129 | B1 * | 3/2008 | Youtsey | 81/467 |
| 7,544,086 | B1 * | 6/2009 | Wells | 439/489 |
| 7,798,849 | B2 * | 9/2010 | Montena | 439/583 |
| 7,837,501 | B2 | 11/2010 | Youtsey | |
| 2007/0039426 | A1 * | 2/2007 | Chuang | 81/475 |
| 2008/0087145 | A1 * | 4/2008 | Youtsey | 81/467 |
| 2010/0018040 | A1 * | 1/2010 | Bradley | 29/751 |
| 2010/0022120 | A1 * | 1/2010 | Bradley | 439/578 |
| 2010/0294094 | A1 | 11/2010 | Wilson et al. | |

FOREIGN PATENT DOCUMENTS

WO WO-2010/135598 A1 11/2010

OTHER PUBLICATIONS

International Search Report and Written Opinion, PCT/US10/35679, Mailed on Sep. 1, 2010, Applicant: PCT International, Inc., 13 pages.

* cited by examiner

*Primary Examiner* — David B Thomas
(74) *Attorney, Agent, or Firm* — Perkins Coie LLP

(57) ABSTRACT

A torque application device according to the present invention comprises a collar for engaging a fastener, a grip coupled to the collar such that a predetermined maximum torque can be applied to the collar to tighten the fastener, and a slip mechanism to prevent the likelihood that the maximum torque is exceeded. The device may further include an indicator (such as a visual, audible and/or tactile indicator) to indicate that the predetermined maximum torque has been applied.

24 Claims, 6 Drawing Sheets

TORQUE APPLICATION DEVICE

FIELD OF THE INVENTION

The present invention relates to torque application devices, and more particularly, to torque application devices for use with F-type coaxial cable connector fasteners or similar devices, wherein the device can apply the proper amount of torque and is not likely to over tighten the fastener.

BACKGROUND OF THE INVENTION

In many applications, fasteners such as nuts, bolts, screws, clasps, and clamps require the application of sufficient torque to properly engage, but can also be over-tightened, potentially damaging the fastener and/or the structure to which the fastener is attached (sometimes referred to herein as an attachment structure). One such fastener is the fastener for a screw-on, F-type connector. F-type connectors (or "F-connectors") are used on most radio frequency (RF) coaxial cables to interconnect TVs, cable TV decoders, VCR/DVD's, hard disk digital recorders, satellite receivers, and other devices. Female F-type connectors (sometimes called the "female connector" or "female F-connector") have a standardized design, generally using a 7/16 inch hex nut as a fastener. The nut has a relatively short (e.g., 1/8 to 1/4 inch) length and can be grasped by a person's fingers to be tightened or loosened.

In order to maintain a tight electrical connection, and to achieve the intended electrical performance, manufacturers and industry standards often require an F-type connector to be tightened to an attachment structure (with respect to F-connectors, these attachment structures are sometimes called the "male connector" or "male F-connector") beyond the torque achievable by using only a person's fingers. In the case of cable TV products, for example, the standard has been to tighten the fastener using a 25 in-lb torque (or to tighten another 90-120 degrees from the finger-tight position). Conversely, consumer products, which have weaker attachment structures (such as plastic), require F-type connector fasteners to be wrench-tightened just slightly beyond finger tight.

A person tightening a fastener by hand may only be able to apply 4-5 ft-lbs of torque to an F-connector fastener using his/her fingers, whereas 10-25 ft-lbs of torque may be required to properly secure an F-connector fastener to an attachment structure. If a person were, however, to use a wrench to tighten the same fastener, in addition to the wrench being bulky and inconvenient, the person runs the risk of over-tightening the fastener and potentially damaging the attachment structure. Applying too little or too much torque can thus result in increases in returns to the manufacturer, customer service calls, and complaints from consumers.

Therefore, it is desirable to tighten many fasteners by hand and be able to apply sufficient torque to tighten the fastener without over-tightening the fastener. Further, different products may require differing amounts of torque to adequately tighten F-type connectors to achieve optimal performance and it would also be an advantage to supply a kit of different devices to be used, respectively, with different fasteners.

SUMMARY OF THE INVENTION

The present invention allows the torque applied by a user's hand or by a tool to be magnified to tighten a fastener to a predetermined level, and greatly reduces the likelihood that a user could over-tighten the fastener beyond that point.

A torque application device according to the present invention comprises (1) a collar for engaging a fastener, (2) a grip coupled to the collar, wherein the grip is configured to increase the amount of torque applied by a person's hand, such that a predetermined maximum torque can be applied to the collar to tighten the fastener, and (3) a slip mechanism that partially or totally decouples the collar and grip when the maximum torque is reached. Preferably, a passage is defined by the device to allow a wire or cable (to which the fastener is preferably attached) to pass through the device. The device may further include an indicator(s) (such as a visual, tactile, and/or audible indicator(s)) to indicate when the predetermined maximum torque has been applied.

The torque application device can be attached to currently-produced fasteners after or before the fastener is attached to a cable, or the fastener can be positioned on a cable to be attached to a fastener prior to the cable being, or after the cable is, attached to the fastener. Alternately, the device of the present invention could be permanently affixed to a fastener and could possibly be integrally formed with the fastener.

Both the foregoing summary and the following detailed description are exemplary only and are not restrictive of the invention.

DETAILED DESCRIPTION OF EXEMPLARY EMBODIMENTS

Figure 1A:
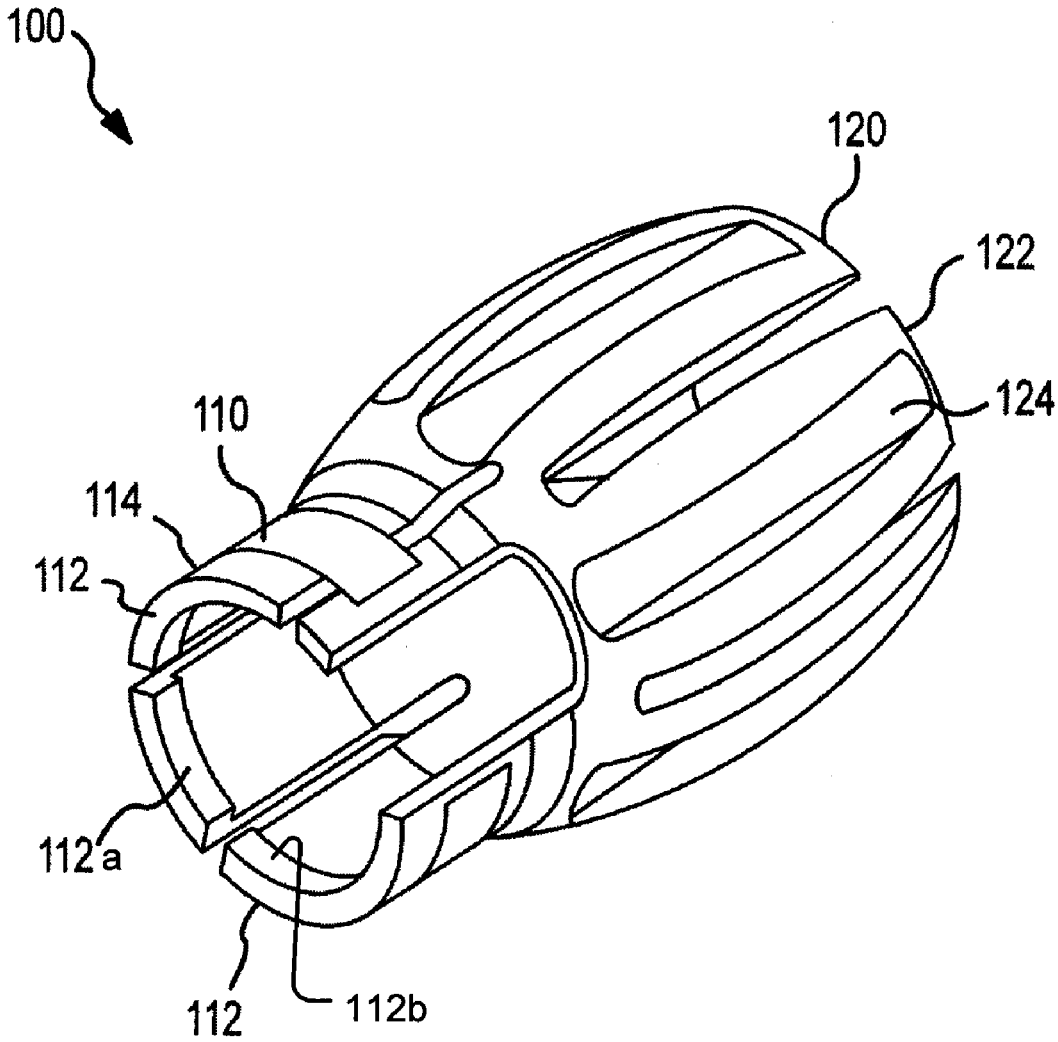
FIG. 1A depicts an exemplary torque application device according to aspects of the present invention.

An exemplary torque application device 100 according to aspects of the present invention is depicted in FIGS. 1A, 2, 4A and 4B includes a collar 110, a grip 120, and a slip mechanism 410. The device 100 allows a user to use his/her hand, fingers or a tool to apply a predetermined maximum torque to a fastener, such as an F-type coaxial cable connector fastener 210 (shown here as a hexagonal nut), so that the fastener is fully tightened, but not over-tightened.

The collar 110 is configured to engage one or more fasteners and can be of any suitable structure or material suitable for use with a particular fastener and fastening application. The collar 110 can be configured to engage any suitable size and type of fastener(s), such as nuts, bolts, screws, clasps, and/or clamps. In the exemplary embodiment depicted in FIGS. 1A and 2, the collar 110 is made of plastic, such as polyethylene or any suitable plastic, and includes a plurality of longitudinally-extending portions 112 that engage the hexagonal nut fastener 210 of a F-type connector. A fastening ring 114 assists sections 112 in gripping the fastener 210. Sections 112 may have raised segments 112A each having an inner wall 112B. In this embodiment, when collar 110 is positioned on a fastener such as fastener 210, the fastener 210 is retained in collar 110 behind inner walls 112B. In this manner, device 100 can remain attached to the fastener for later use to either loosen or tighten the fastener 210.

Figure 1B:
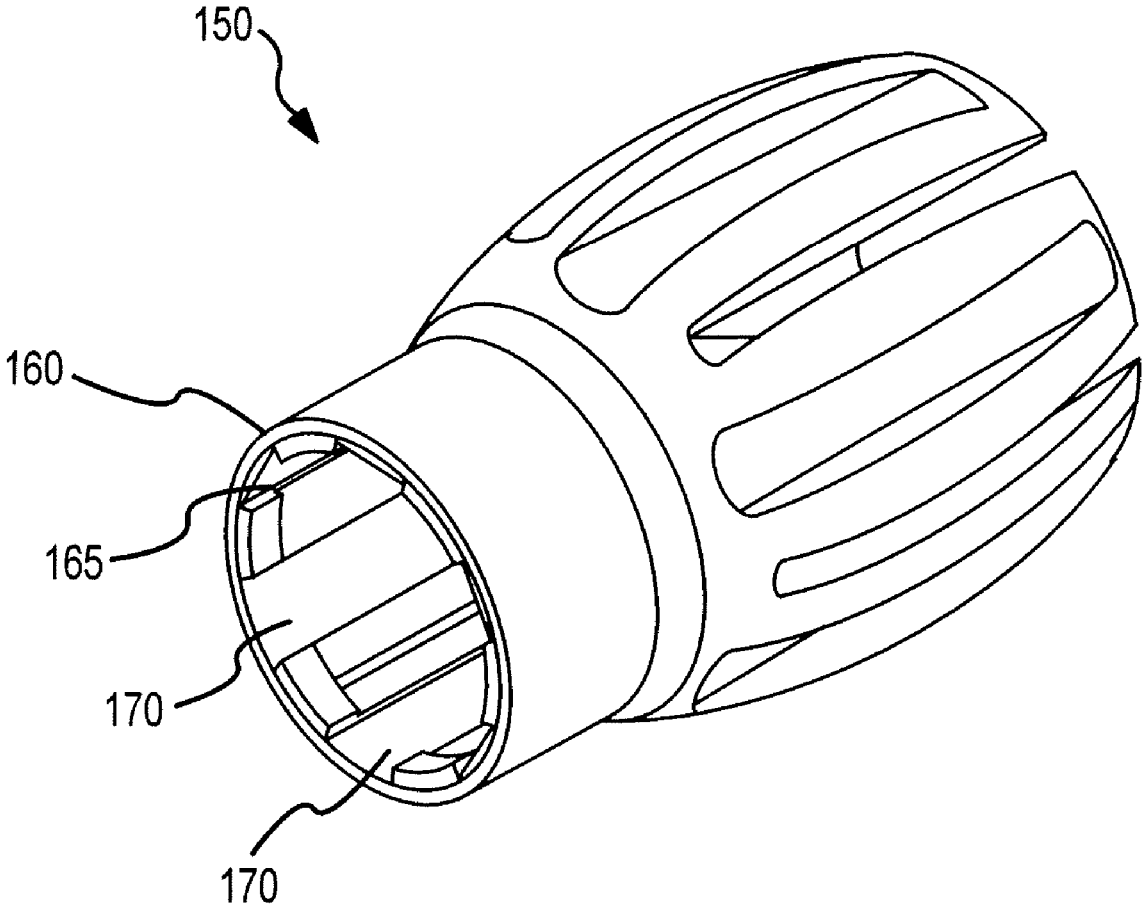
FIG. 1B depicts another exemplary torque application device according to aspects of the present invention.

In another exemplary embodiment of the present invention, referring now to FIG. 1B, device 150 includes a collar 160 that comprises an inner portion 165 with flat portions 170 arranged about the longitudinal axis of the device 150 for engaging an F-type connector. In this embodiment, the collar 160 is configured to fit over, and snap onto, an F-type connector to allow a user to apply torque to the connector. The collar 160 can alternately be configured to engage any other suitable type of connector. As with collar 110, collar 160 may be formed from any suitable materials. The collar 160 can interact with the grip 120 in the same manner described below for the collar 110.

The grip 120 is configured to receive torque from a person's hand (or fingers) such that torque can be applied, and the grip uses mechanical advantage to generate a greater torque transferred to the collar to tighten the fastener. Once the maximum torque has been applied to the collar 110, grip 120 decouples from collar 110 via the slip mechanism (the preferred embodiment of which is described below) and no additional torque above the maximum torque is applied. This helps to ensure that the fastener engaged by the collar 110 is fully tightened, and prevents or greatly reduces the likelihood of the fastener being over-tightened.

The grip 120 can be configured to receive torque from any suitable source, may be formed from any suitable material(s), and may be of any suitable size, shape and configuration. In the exemplary embodiments depicted in FIGS. 1A, 1B, and 2, the grip 120 is comprised of plastic, such as polyethylene, is between about 17 mm and about 20 mm long, 13 mm in diameter (at its widest point), and is configured to receive torque applied by a human hand. In the exemplary embodiment, the grip 120 includes a plurality of struts 122 arranged about its central axis. In this embodiment, the struts 122 are non-rectilinear and each includes a groove 124 to help the fingers or hand grasp the grip 120. The grip 120 is formed from semi-rigid plastic to allow a human hand or fingers to squeeze and twist the grip 120 and deliver torque to the device 100 without excessively deforming the grip 120.

Figure 2:
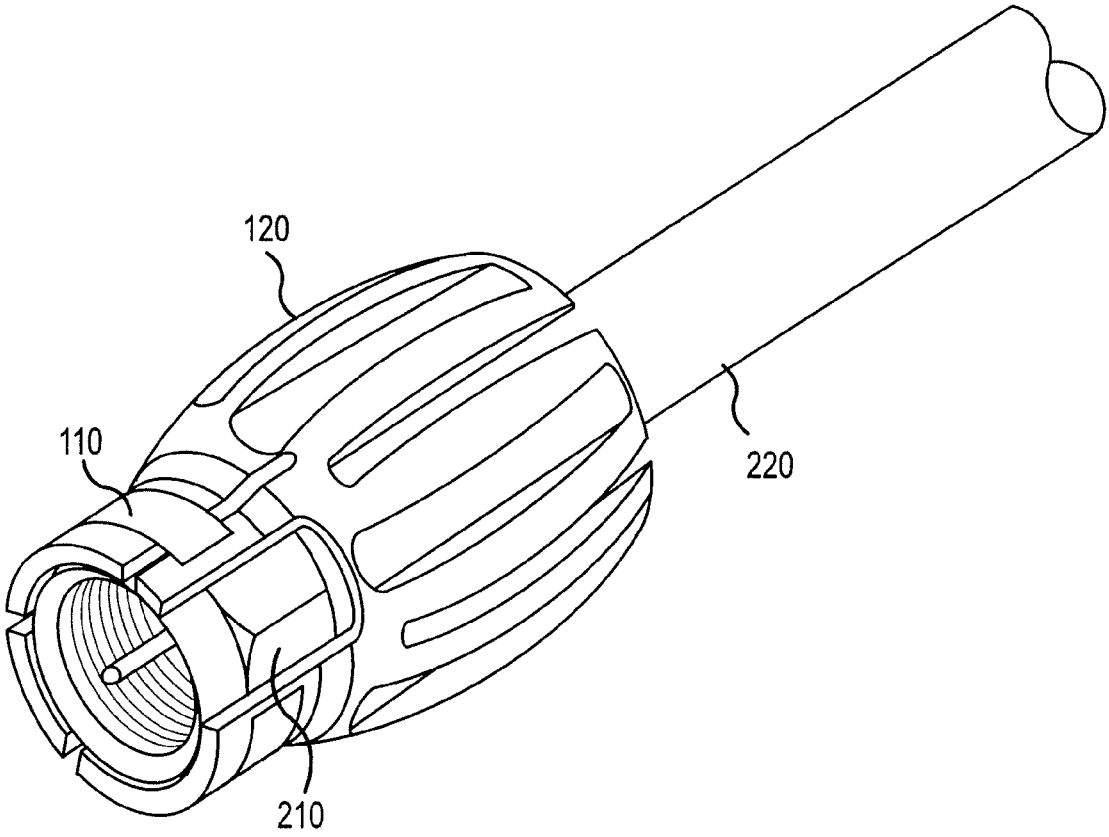
FIG. 2 depicts the device of FIG. 1A engaging an F-type connector fastener that is connected to a cable that extends through the device.

In the exemplary device, the collar 110 comprises an opening for receiving the fastener. The grip 120 also comprises an opening which is in communication with the opening in the collar. The openings in the collar 110 and the fastener 120 define a passage through the device 100. This passage allows for the cable 220, attached to the F-type connector fastener 210, to pass through the device, as shown in FIG. 2.

The grip 120 and the collar 110 are decoupled when at least the predetermined maximum torque is applied to the collar 110. In this context, the term "decoupled" means any disengagement, whether complete or partial, of the grip 120 and collar 110 that prevents the collar 110 from receiving torque beyond the predetermined maximum torque. As discussed with reference to FIGS. 4A and 4B, this decoupling may be accomplished by the use of a slip mechanism 410, which is the preferred embodiment and comprises the traversal of protrusions 420 on a surface (the "first surface") of the grip 120 over protrusions 430 on a surface (the "second surface") of the collar 110 once the predetermined maximum torque has been applied to the collar 110.

Figure 4A:
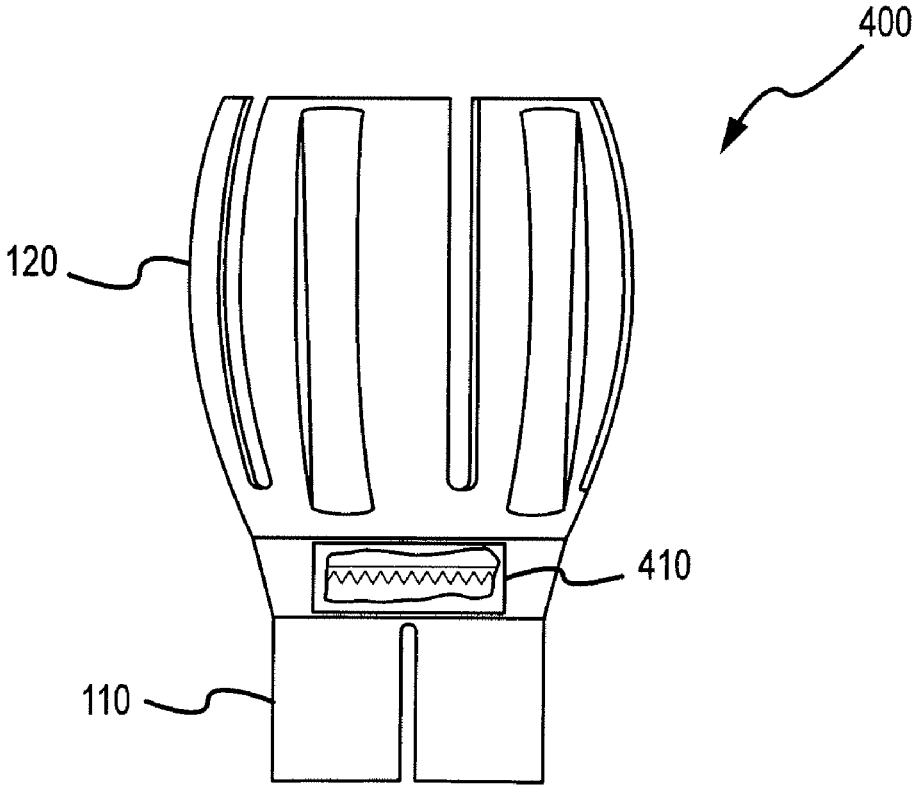
FIG. 4 depicts another exemplary torque application device according to various aspects of the present invention.
Figure 4B:
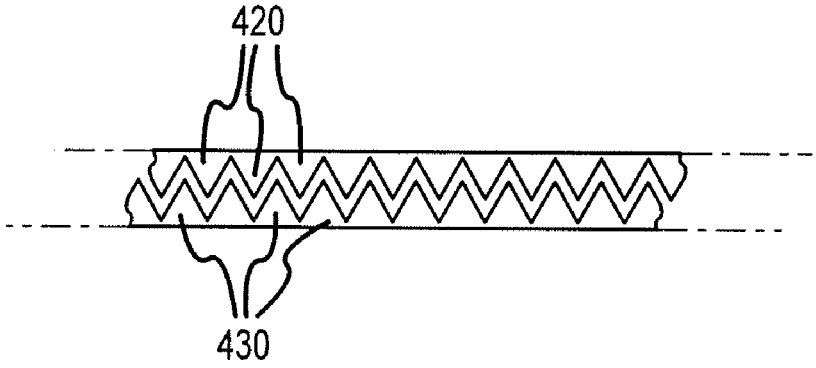

In the exemplary embodiment depicted in FIGS. 4A and 4B, the protrusions 420 and 430 have a triangular cross-section, however such protrusions can have any suitable size, shape, configuration, and spacing. If protrusions, such as protrusions 420, 430, are utilized as the slip mechanism, they can be appropriately designed to allow for differing maximum amounts of torque. Alternatively, different materials (potentially in conjunction with different shape configurations) may be used to allow for different maximum amounts of torque. This enables the present invention to be custom-configured to apply different maximum torques for different applications.

A device according to the invention may be removably or semi-permanently, or permanently, attached to a fastener. A device may be removably or semi-permanently attached to a fastener by positioning the device so that the collar 110 receives the fastener, such as a hexagonal nut 210, as depicted in FIG. 2. Cable 220 would extend through the passage defined in the device, and the device would be attached to the fastener prior to fully tightening the fastener to an attachment structure. In the embodiment shown in FIG. 2, the fastener 210 would be received and retained in the opening of the collar 110 behind the inner walls 112B. Device 100 may, however, not include sections 112A and collar 110 would simply be moved into position onto a fastener, such as fastener 210, when being used to loosen or tighten the fastener, and then be removed from the fastener but still retained on cable 220 for future use if required.

Alternately, the device 100 can be permanently affixed to the fastener, or be integrally formed with the fastener, prior to attaching the fastener to a cable, such as cable 220. In that case, the fastener would replace the collar 110 and the fastener would be directly coupled to the grip 120 with the slip mechanism formed on the grip and/or fastener.

Figure 3A:
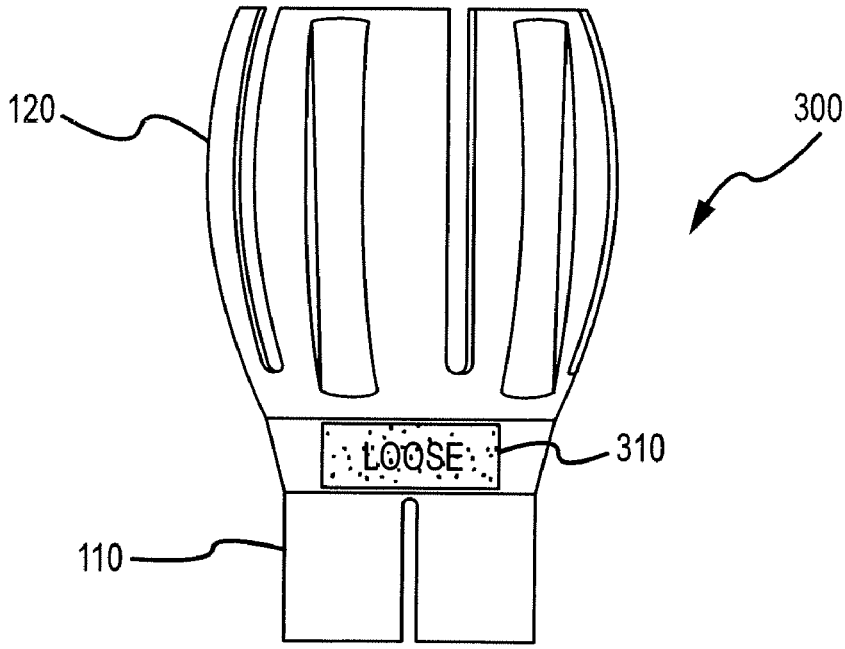
FIGS. 3A and 3B depict the device of FIG. 1A with visual indicators showing whether a predetermined maximum torque has been applied.
Figure 3B:
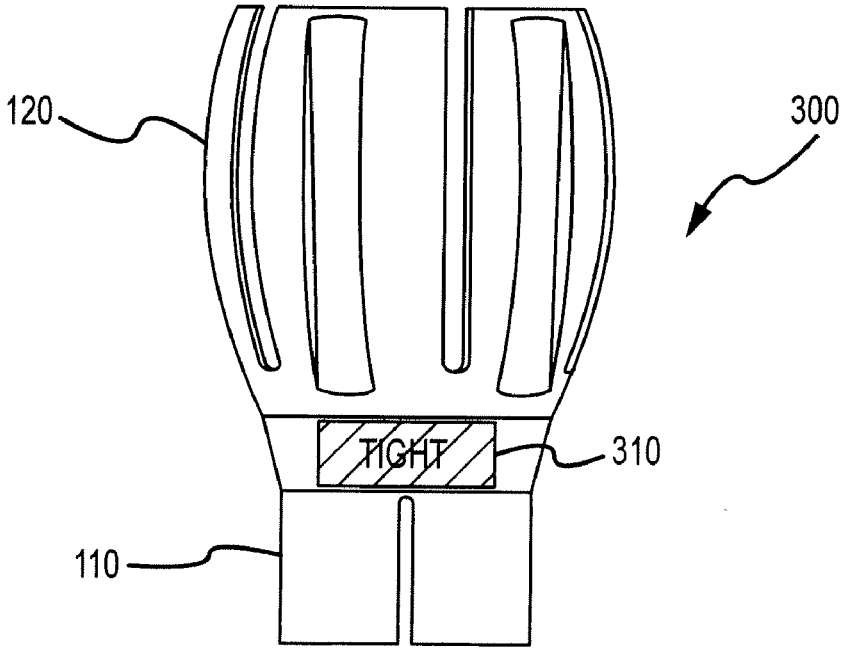

Another device according to the present invention is depicted in FIGS. 3A and 3B. In this exemplary embodiment, device 300 includes a visual indicator 310 to show when a predetermined maximum torque has been applied to the collar 110. In this embodiment, the visual indicator 310 comprises a first message ("LOOSE") and/or a first color (such as green) to indicate that the maximum torque has not been applied to the collar, and therefore the fastener is still not sufficiently tightened. Conversely, once the maximum torque has been applied to the collar 110 and the fastener is fully tightened, the first message is replaced by a second message ("TIGHT") and/or with a second color (such as red).

An audible indicator can be used with, or used instead of, visual indicator 310 to indicate that the predetermined maximum torque has been applied to the collar 110. Referring to FIGS. 4A and 4B, for example, the grip 120 and collar 110 of device 400 comprise protrusions 420 and 430, respectively. As shown in FIG. 4B, the protrusions 420 and 430 engage each other when less than the maximum amount of torque is applied to the collar 110. This allows torque to be applied to the collar 110 via the grip 120. Once a torque greater than the maximum amount of torque permitted by the slip mechanism is applied to the collar 110, protrusions 420 traverse protrusions 430, and may create an audible clicking sound that alerts a user applying force to the device 400 that the maximum amount of torque has been applied.

Finally, a tactile indicator could be used in addition to, or instead of, a visual indicator and/or audible indicator. Again, with respect to protrusions 420 and 430, a user will feel slippage when the maximum torque is reached.

Figure 5:
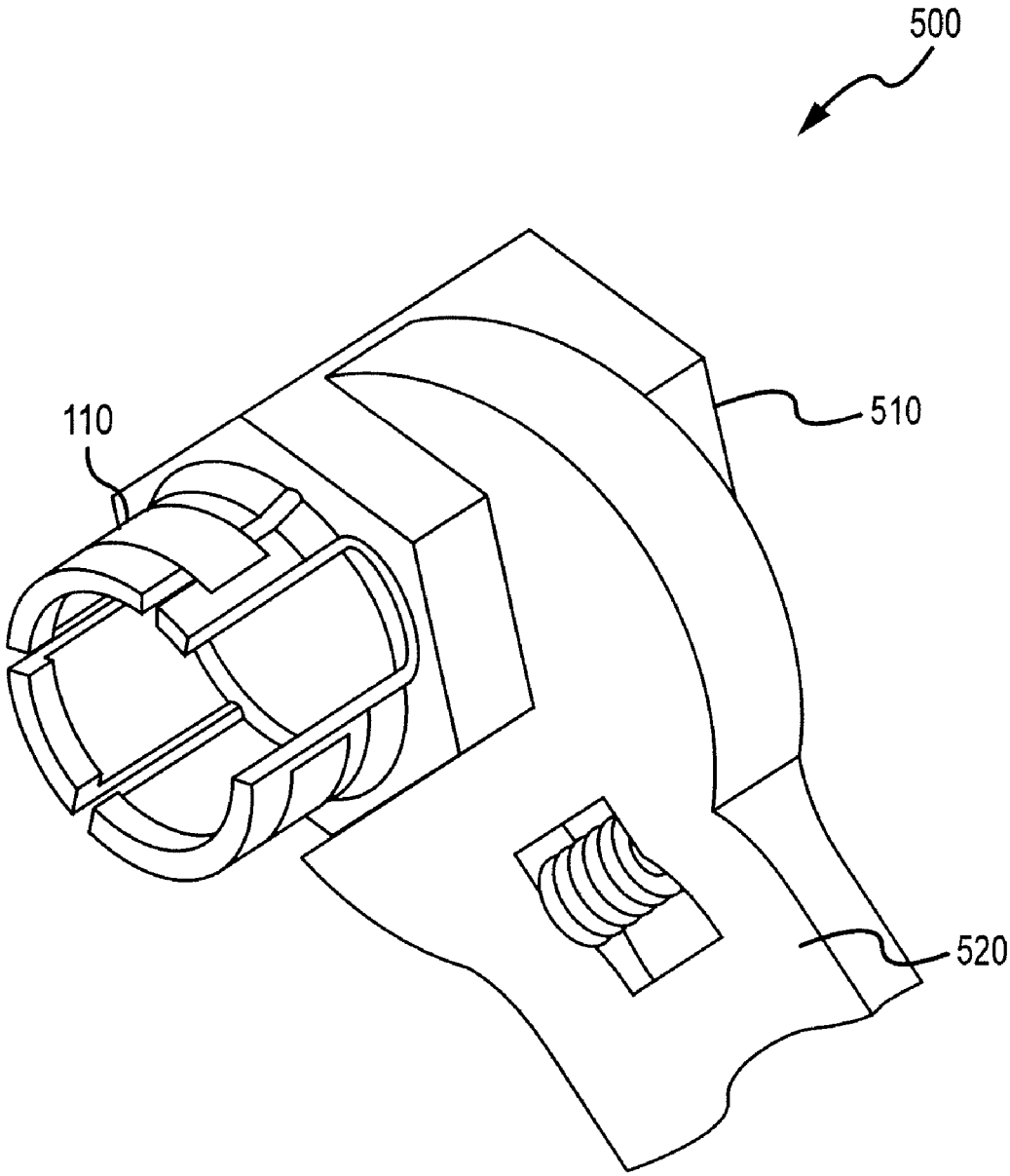
FIG. 5 depicts yet another exemplary torque application device according to various aspects of the present invention.

In another exemplary embodiment, referring now to FIG. 5, a device 500 includes a grip 510 that is configured to receive torque applied by a tool 520. In this exemplary embodiment, grip 510 includes a hexagonal exterior for engagement with tool 520, which as shown is a wrench.

The interior of grip 510 is hollow to allow the device 500 to slide over a cable 220 attached to an F-type connector fastener 210. Among other things, the grip 510 provides a larger hexagonal area for an installer to engage with a tool 520 than is available on the F-type connector 210 itself. As with other devices of the present invention, the device 500 will only allow the predetermined maximum torque to be applied to the collar when tightening the fastener, such that an installer is unlikely to over-tighten the fastener. The slip mechanism and collar are preferably of the same configuration as previously described for device 100. Device 500 may also include one or more of the previously-described indicators.

Devices of the present invention can be configured to apply any desired maximum torque to a fastener. For example, any suitable torque that can be applied by hand tightening (using the grip) could be applied, such as any torque between 5 and 25 ft-lbs. Devices providing differing maximum torques can be color-coded, or designated in any other suitable manner, to allow a user to quickly identify which device to use when installing a particular fastener.

The particular implementations shown and described above are illustrative of the invention and its best mode and are not intended to limit the scope of the invention in any way. Methods illustrated in the various figures may include more, fewer, or other steps. Additionally, steps may be performed in any suitable order without departing from the scope of the invention. Changes and modifications may be made to the disclosed embodiments without departing from the scope of the present invention. These and other changes or modifications are intended to be included within the scope of the present invention, as expressed in the appended claims.

What is claimed is:

1. A torque application device comprising:

a first end portion spaced apart from a second end portion;

a collar having a first opening positioned toward the first end portion for engaging a fastener;

a grip coupled to the collar and extending away from the collar toward the second end portion, wherein the grip includes a second opening positioned toward the second end portion and in communication with the first opening, and wherein the grip is configured to magnify torque applied to it and to transfer all or part of the magnified torque to the collar; and a slip mechanism that partially or completely decouples the collar and the grip such that a predetermined maximum torque can be applied to the collar to tighten the fastener, wherein at least one of the grip and the collar is configured to provide a first visual indicator configured to display when the predetermined maximum torque has been applied to the collar, and a second visual indicator configured to display when the predetermined torque has not been applied to the collar.

2. The device of claim 1, wherein the first visual indicator comprises a first color and the second visual indicator comprises a second color.

3. A torque application device comprising:

a collar for engaging a fastener;

a grip coupled to the collar, the grip configured to magnify torque applied to it and to transfer all or part of the magnified torque to the collar; and a slip mechanism that partially or completely decouples the collar and the grip such that a predetermined maximum torque can be applied to the collar to tighten the fastener, wherein at least one of the grip and the collar is configured to provide a first visual indicator configured to display when the predetermined maximum torque has been applied to the collar, wherein the first visual indicator comprises a first written indicia, and wherein the device further comprises a second visual indicator configured to display when the predetermined torque has not been applied to the collar, wherein the second visual indicator comprises a second written indicia.

4. A torque application device comprising:

a first end portion spaced apart from a second end portion;

a collar having a first opening positioned toward the first end portion for engaging a fastener;

a grip coupled to the collar and extending away from the collar toward the second end portion, wherein the grip includes a second opening positioned toward the second end portion and in communication with the first opening, wherein the grip comprises a plurality of struts arranged about a central axis of the grip, and wherein the grip is configured to magnify torque applied to it and to transfer all or part of the magnified torque to the collar; and a slip mechanism that partially or completely decouples the collar and the grip such that a predetermined maximum torque can be applied to the collar to tighten the fastener.

5. The device of claim 4, wherein at least one of the grip and the collar is configured to provide an indicator that the predetermined maximum torque has been applied to the collar.

6. The device of claim 2, wherein the indicator comprises at least one of an audible indicator, a visual indicator and a tactile indicator.

7. The device of claim 4, wherein the openings in the collar and the grip define a passage, the passage configured to allow a cable to extend through the torque application device.

8. The device of claim 4, wherein the fastener is one or more of:

a nut;

a bolt;

a screw;

a clasp; and a clamp.

9. The device of claim 4, wherein the grip has a first surface and the collar has a second surface, and the slip mechanism includes:

a first plurality of protrusions on the first surface; and a second plurality of protrusions on the second surface, wherein the first plurality of protrusions engage the second plurality of protrusions when less than the maximum amount of torque is applied to the collar.

10. The device of claim 9, wherein the first plurality of protrusions traverse over the second plurality of protrusions when at least the maximum amount of torque is applied to the collar.

11. The device of claim 10, wherein the traversal of the first plurality of protrusions over the second plurality of protrusions produces an audible indication that the maximum torque has been reached.

12. The device of claim 4, further comprising the fastener.

13. The device of claim 4 wherein the collar comprises sections that include raised segments, the fastener being retained behind the raised segments when the fastener is retained in the first opening.

14. A torque application device comprising:

a collar for engaging a fastener;

a grip coupled to the collar, the grip configured to magnify torque applied to it and to transfer all or part of the magnified torque to the collar, wherein the grip comprises a plurality of struts arranged about a central axis of the grip, and wherein at least one of the plurality of struts is nonrectilinear; and a slip mechanism that partially or completely decouples the collar and the grip such that a predetermined maximum torque can be applied to the collar to tighten the fastener.

15. The device of claim 14, wherein the grip is comprised of plastic.

16. The device of claim 14, wherein the collar is configured to releasably engage the fastener.

17. The device of claim 14, wherein the collar is comprised of plastic.

18. The device of claim 14, wherein the collar comprises an opening for receiving the fastener.

19. A torque application device comprising:

a collar for engaging a fastener, wherein the collar comprises an opening for receiving the fastener and sections that include raised segments, the fastener being retained behind the raised segments when the fastener is retained in the opening;

a grip coupled to the collar, the grip configured to magnify torque applied to it and to transfer all or part of the magnified torque to the collar; and a slip mechanism that partially or completely decouples the collar and the grip such that a predetermined maximum torque can be applied to the collar to tighten the fastener.

20. The device of claim 19, wherein the grip is configured to receive torque applied by a human hand.

21. The device of claim 19, wherein the grip is configured to receive torque applied by a tool.

22. The device of claim 19 that further includes a fastener positioned in the collar.

23. The device of claim 22 wherein the grip comprises an opening in communication with the opening in the collar, wherein the openings in the collar and the grip define a passage, and wherein the device further includes a cable connected to the fastener, the cable extending through the passage.

24. The device of claim 19 wherein the grip comprises a plurality of struts arranged about a central axis of the grip.

* * * * *

UNITED STATES PATENT AND TRADEMARK OFFICE

CERTIFICATE OF CORRECTION

PATENT NO. : 8,065,940 B2
APPLICATION NO. : 12/470430
DATED : November 29, 2011
INVENTOR(S) : Brandon Wilson et al.

It is certified that error appears in the above-identified patent and that said Letters Patent is hereby corrected as shown below:

In column 6, line 17, in claim 6, delete "claim 2," and insert -- claim 5, --, therefor.

Signed and Sealed this
Twenty-eighth Day of February, 2012

David J. Kappos

David J. Kappos
*Director of the United States Patent and Trademark Office*